US011856665B2

(12) United States Patent
Hsu

(10) Patent No.: US 11,856,665 B2
(45) Date of Patent: Dec. 26, 2023

(54) LAMP-APPARATUS CIRCUIT AND A LAMP APPARATUS

(71) Applicant: DONGGUAN JIASHENG LIGHTING TECHNOLOGY COMPANY LTD, Dongguan (CN)

(72) Inventor: Shui Sheng Hsu, Dongguan (CN)

(73) Assignee: DONGGUAN JIASHENG LIGHTING TECHNOLOGY COMPANY LTD, Dongguan (CN)

( * ) Notice: Subject to any disclaimer, the term of this patent is extended or adjusted under 35 U.S.C. 154(b) by 0 days.

(21) Appl. No.: 17/875,446

(22) Filed: Jul. 28, 2022

(65) Prior Publication Data

US 2023/0371147 A1 Nov. 16, 2023

(30) Foreign Application Priority Data

May 13, 2022 (CN) ..... 202221163591.0

(51) Int. Cl.
*H05B 45/30* (2020.01)
*H05B 45/327* (2020.01)
*H05B 45/325* (2020.01)
*H05B 45/28* (2020.01)

(52) U.S. Cl.
CPC ..... *H05B 45/327* (2020.01); *H05B 45/28* (2020.01); *H05B 45/325* (2020.01)

(58) Field of Classification Search
CPC ..... H05B 45/20; H05B 45/46; H05B 45/325; H05B 45/355; H05B 45/375; H05B 45/395; H05B 45/397; H05B 45/3725
See application file for complete search history.

(56) References Cited

U.S. PATENT DOCUMENTS

| | | | | |
|---|---|---|---|---|
| 10,172,207 | B1 * | 1/2019 | Hsu | H05B 45/20 |
| 10,448,471 | B1 * | 10/2019 | Chowdhury | H05B 47/19 |
| 10,945,317 | B1 | 3/2021 | Hsu | |
| 11,483,908 | B1 * | 10/2022 | Wang | H05B 45/20 |
| 2015/0264756 | A1 | 9/2015 | Xu | |
| 2017/0245338 | A1 * | 8/2017 | Turunen | H05B 47/16 |
| 2018/0103518 | A1 * | 4/2018 | Janik | H05B 45/24 |
| 2019/0110343 | A1 * | 4/2019 | Van Kaathoven | H05B 45/46 |
| 2023/0023755 | A1 * | 1/2023 | Archer | H05B 45/20 |

* cited by examiner

*Primary Examiner* — Tung X Le
(74) *Attorney, Agent, or Firm* — Andrew C. Cheng

(57) ABSTRACT

The present disclosure relates to the technical field of lighting circuit, and more particularly to a lamp-apparatus circuit and a lamp apparatus. The lamp-apparatus circuit includes a drive module, a dimming module and a switch module for adjusting the current of the output terminal of the drive module, which are electrically connected. The dimming module includes a dimming circuit, a light-emitting circuit and a multi-position control circuit for controlling the dimming circuit to adjust the color temperature of the light-emitting circuit, which are electrically connected. The dimming module as a whole and the color temperature of the light-emitting circuit can be adjusted simply in operation. The color temperature adjustment means of the lamp apparatus are more diverse and more convenient, and the control circuit is a multi-position control circuit, which improves the flexibility of the color temperature adjustment of the lamp apparatus.

16 Claims, 3 Drawing Sheets

LAMP-APPARATUS CIRCUIT AND A LAMP APPARATUS

TECHNICAL FIELD

The present disclosure relates to the technical field of lighting circuit, and more particularly to a lamp-apparatus circuit and a lamp apparatus.

BACKGROUND

LED (Light-emitting Diode), widely used in various lighting and decoration fields, is a common light-emitting device that emits energy by recombining electrons and holes.

With the development of society, the types of lamps are becoming more and more diverse. To meet the needs of users, lamps with adjustable color temperatures have appeared. However, with the gradual improvement of LED application technology, the simple color temperature function of lamps is far from meeting the needs, and it is necessary to pursue a more intelligent, more convenient, and more versatile intelligent color temperature adjustment circuit.

SUMMARY

To solve the problem that the existing LED color temperature adjustment circuit cannot meet the needs of users, the present disclosure provides a lamp-apparatus circuit and a lamp apparatus.

To solve the technical problem, the present disclosure provides a lamp-apparatus circuit, which includes a switch module, a drive module and a dimming module that are electrically connected.

The input and output terminals of the switch module are respectively connected to the power supply and the input terminal of the drive module, and the switch module is used to adjust the current of the output terminal of the drive module. The output terminal of the drive module is connected to the dimming module to drive the dimming module.

The dimming module includes a multi-position control circuit, a dimming circuit and a light-emitting circuit that are electrically connected. The dimming circuit is connected in series with the light-emitting circuit, and the multi-position control circuit adjusts the color temperature of the light-emitting circuit by controlling the dimming circuit.

Preferably, the light-emitting circuit includes a plurality of light-emitting branch circuits in parallel, and the dimming circuit is correspondingly provided with a plurality of dimming branch circuits. The input and output terminals of each of the dimming branch circuits are respectively connected to the multi-position control circuit and the corresponding light-emitting branch circuits. The input terminals of the light-emitting branch circuits are connected to the output terminal of the driving module, and the output terminals of all the light-emitting branch circuits are grounded simultaneously.

Preferably, each of the light-emitting branch circuits includes at least one light-emitting diode.

Preferably, the multi-position control circuit includes an MCU and a multi-position switch that are electrically connected. The first terminals of each position of the multi-position switch are connected to the corresponding function pin of the MCU, and the second terminals thereof are grounded simultaneously. The MCU is provided with a plurality of signal terminals, and the MCU is connected to the corresponding input terminals of the dimming branch circuits via the signal terminals. The signal terminal of the MCU includes seven pins, and the third pin, the fifth pin and the seventh pin thereof are respectively connected with the corresponding input terminals of the dimming branch circuits.

Preferably, the multi-position switch includes a plurality of first-type-position switches, and the MCU can output different PWM signals by toggling different position switches, thereby adjusting the light-emitting circuit to work at different color temperatures.

Preferably, the multi-position switch includes a second-type-position switch. By toggling the second-type-position switch, the MCU will cyclically output PWM signals corresponding to each of the first-type-position switches based on the switching times of the switch module, so as to automatically switch the color temperature of the light-emitting circuit.

Preferably, the dimming circuit includes a MOS transistor, two conducting terminals of the MOS transistor is connected in series between the light-emitting diode of the light-emitting branch circuit and the driving module, and the control terminal of the MOS transistor is connected to the signal terminal of the MCU. The MCU controls the current of the MOS transistor via the signal terminal to realize the color temperature adjustment of the light-emitting circuit.

Preferably, the switch module includes a TRIAC dimming switch.

Preferably, the drive module includes a PWM constant-current chip.

To solve the above problem, the present disclosure further provides a lamp apparatus, the circuit of the lamp apparatus is the above-mentioned lamp-apparatus circuit.

Compared with the prior art, the lamp apparatus and the lamp-apparatus circuit of the present disclosure have the following beneficial effects.

A lamp-apparatus circuit includes a switch module, a drive module and a dimming module that are electrically connected. The input and output terminals of the switch module are respectively connected to the power supply and the input terminal of the drive module, and the switch module is used to adjust the current of the output terminal of the drive module. The output terminal of the drive module is connected to the dimming module to drive the dimming module. The dimming module includes a multi-position control circuit, a dimming circuit and a light-emitting circuit that are electrically connected. The dimming circuit is connected in series with the light-emitting circuit, and the multi-position control circuit adjusts the color temperature of the light-emitting circuit by controlling the dimming circuit. It can be understood that, in the lamp-apparatus circuit of this embodiment, the dimming module can be adjusted as a whole by adjusting the current via the switch module, and the color temperature of the light-emitting circuit can be adjusted via the control circuit and the dimming circuit in the dimming module. Thus, the color temperature adjustment means of the lamp apparatus are more diverse and more convenient; moreover, the control circuit is a multi-position control circuit, which improves the flexibility of the color temperature adjustment of the lamp apparatus.

The light-emitting circuit of the present disclosure includes a plurality of light-emitting branch circuits in parallel, and the dimming circuit is correspondingly provided with a plurality of dimming branch circuits. The input and output terminals of each of the dimming branch circuits are respectively connected to the multi-position control circuit and the corresponding light-emitting branch circuits. The input terminals of the light-emitting branch circuits are connected to the output terminal of the driving module, and the output terminals of all the light-emitting branch circuits are grounded simultaneously. The overall brightness of the lamp-apparatus circuit can be effectively improved via the plurality of light-emitting branch circuits in parallel, which improves the practicability of the lamp-apparatus circuit. The voltage of each of the light-emitting branch circuits is equal by arranging the plurality of light-emitting branch circuits in parallel, which is more conducive to controlling the close and open circuit of the light-emitting branch, and further improves the practicability and controllability of the lamp-apparatus circuit.

Each of the light-emitting branch circuits of the present disclosure includes at least one light-emitting diode. It can be understood that the number of light-emitting diodes can be set according to actual requirements. By arranging a plurality of light-emitting diodes, the brightness of the lamp-apparatus circuit 100 can be effectively improved, and the practicability thereof can be accordingly improved.

The multi-position control circuit includes an MCU and a multi-position switch that are electrically connected. The first terminals of each position of the multi-position switch are connected to the corresponding function pin of the MCU, and the second terminals thereof are grounded simultaneously. The MCU is provided with a plurality of signal terminals, and the MCU is connected to the corresponding input terminals of the dimming branch circuits via the signal terminals. The signal terminal of the MCU includes seven pins, and the third pin, the fifth pin and the seventh pin thereof are respectively connected with the corresponding input terminals of the dimming branch circuits. The multi-position switch includes a plurality of first-type-position switches, and the MCU can output different PWM signals by toggling different position switches, thereby adjusting the light-emitting circuit to work at different color temperatures. It can be understood that by toggling the first-type-position switch, the MCU can be controlled to output different PWM signals to adjust the color temperature of the light-emitting circuit, which is convenient for the user to operate. The number of the first-type positions is more than one, which enhances the color temperature adjustment function of the lamp-apparatus circuit and makes the color temperature of the lamp apparatus more diverse.

The multi-position switch includes a second-type-position switch. By toggling the second-type-position switch, the MCU will cyclically output PWM signals corresponding to each of the first-type-position switches based on the switching times of the switch module, so as to automatically switch the color temperature of the light-emitting circuit. It can be understood that in addition to manually switching the color temperature, the lamp-apparatus circuit can also enter the automatic color temperature switching mode by toggling the second-type-position switch, which improves the intelligence of the lamp-apparatus circuit and further enhances the practicality thereof.

The dimming circuit includes a MOS transistor, two conducting terminals of the MOS transistor is connected in series between the light-emitting diode of the light-emitting branch circuit and the driving module, and the control terminal of the MOS transistor is connected to the signal terminal of the MCU. The MCU controls the current of the MOS transistor via the signal terminal to realize the color temperature adjustment of the light-emitting circuit. It can be understood that the lamp-apparatus circuit realizes the adjustment of the color temperature of the light-emitting circuit by adjusting the current of the MOS transistor, and is simple in structure and high in accuracy.

The switch module includes a TRIAC dimming switch. It can be understood that the TRIAC, as a silicon-controlled rectifier, can realize a non-contact control of alternating current in the circuit, which has high reliability.

The drive module includes a PWM constant-current chip. It can be understood that a stable current can be provided for the dimming module via the PWM constant-current chip, thereby ensuring the stable operation of the dimming module.

To solve the above problem, the present disclosure further provides a lamp apparatus, the circuit of the lamp apparatus is the above-mentioned lamp-apparatus circuit, so the lamp apparatus also has the same beneficial effect as the above-mentioned lamp-apparatus circuit.

BRIEF DESCRIPTION OF THE DRAWINGS

To illustrate the technical solutions in the embodiments of the present disclosure more clearly, the following briefly introduces the accompanying drawings used in the description of the embodiments or the prior art. Obviously, the drawings in the following description are only some embodiments of the present disclosure, and for those skilled in the art, other drawings can also be obtained according to the drawings without any creative effort.

NUMERICAL REFERENCE IDENTIFICATION

Figure 1:
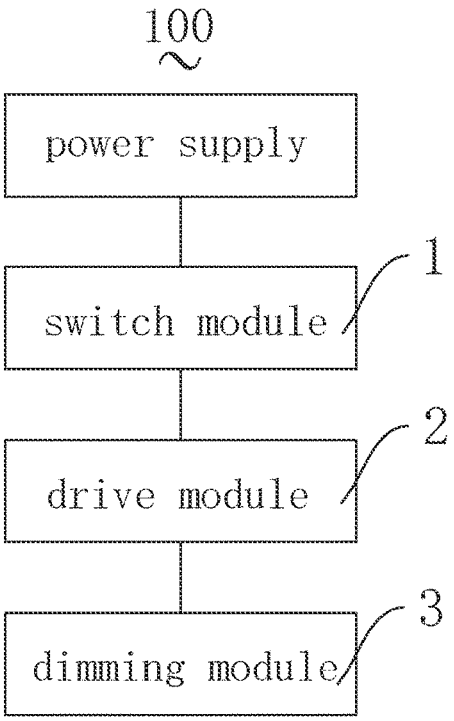
FIG. 1 is a circuit block diagram of a lamp-apparatus circuit according to a first embodiment of the present disclosure.

100. lamp-apparatus circuit; 200. lamp apparatus;
1. switch module; 2. drive module;
3. dimming module; 31. multi-position control circuit; 311, MCU; 312, multi-position switch; 32. dimming circuit; 33. light-emitting circuit;
4. main body; 5. circuit component.

DETAILED DESCRIPTION

In order to make the objectives, technical solutions, and advantages of the present disclosure clearer, the present disclosure is further described in detail below with reference to the accompanying drawings and embodiments. It should be understood that the specific embodiments described herein are provided for illustration only, and not for the purpose of limiting the disclosure.

It should be noted that, when an element is referred to as being "fixed to" another element, it can be directly on the other element or intervening elements may also exist. When an element is referred to as being "connected" to another element, it can be directly connected to the other element or intervening elements may also exist. The terms "vertical", "horizontal", "left", "right" and similar expressions are used herein for illustrative purposes only.

It should be noted that, in the present disclosure, the terms "up", "down", "left", "right", "front", "rear", "top", "bottom", "inside", "outside", "middle", "vertical", "horizontal", "longitudinal", etc. are based on the orientations or positional relationships shown in the drawings. Terms herein are primarily used to better describe the disclosure and the embodiments, and are not intended to limit that the indicated device, element, or component must have a particular orientation, or be constructed and operated in a particular orientation.

In addition, some of the above-mentioned terms may be used to express other meanings besides orientation or positional relationship. For example, the term "on" may also be used to express a certain attachment or connection relationship in some cases. For those skilled in the art, the specific meanings of the above terms in the present disclosure can be understood according to specific situations.

Furthermore, the terms "install", "arrange", "provide", "connect", "contact" should be construed broadly. For example, it may be a fixed connection, a detachable connection, or an integral structure; it may be a mechanical connection, or an electrical connection; it may be directly connected, or indirectly connected via an intermediary, or an internal communication between two devices, elements, or components. For those skilled in the art, the specific meanings of the above terms in the present disclosure can be understood according to specific situations.

Figure 2:
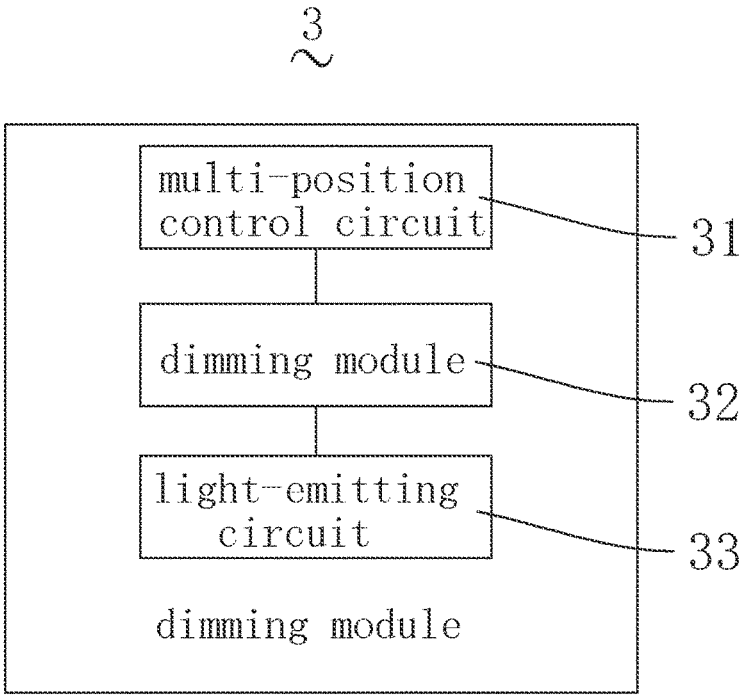
FIG. 2 is a circuit block diagram of a dimming module of the lamp-apparatus circuit according to the first embodiment of the present disclosure.

Referring to FIG. 1 and FIG. 2, a first embodiment of the present disclosure provides a lamp-apparatus circuit 100, which includes a switch module 1, a drive module 2 and a dimming module 3 that are electrically connected.

The input and output terminals of the switch module 1 are respectively connected to the power supply and the input terminal of the drive module 2, and the switch module 1 is used to adjust the current of the output terminal of the drive module 2. The output terminal of the drive module 2 is connected to the dimming module 3 to drive the dimming module 3.

The dimming module 3 includes a multi-position control circuit 31, a dimming circuit 32 and a light-emitting circuit 33 that are electrically connected. The dimming circuit 32 is connected in series with the light-emitting circuit 33, and the multi-position control circuit 31 adjusts the color temperature of the light-emitting circuit 33 by controlling the dimming circuit 32.

It can be understood that in the lamp-apparatus circuit 100 of the present disclosure, the dimming module 3 can be adjusted as a whole by adjusting the current via the switch module 1, and the color temperature of the light-emitting circuit 33 can be adjusted via the control circuit and the dimming circuit 32 in the dimming module 3. Thus, the color temperature adjustment means of the lamp apparatus are more diverse and more convenient; moreover, the control circuit is a multi-position control circuit 31, which improves the flexibility of the color temperature adjustment of the lamp apparatus.

Further, the lamp-apparatus circuit 100 includes a power supply, and the output terminal of the power supply is connected to the input terminal of the switch module 1. Specifically, in this embodiment, an AC power supply is used.

Specifically, in this embodiment, the dimming module 3 of the lamp-apparatus circuit 100 includes a 5CCT (Correlated Color Temperature) color-temperature control circuit.

Figure 3:
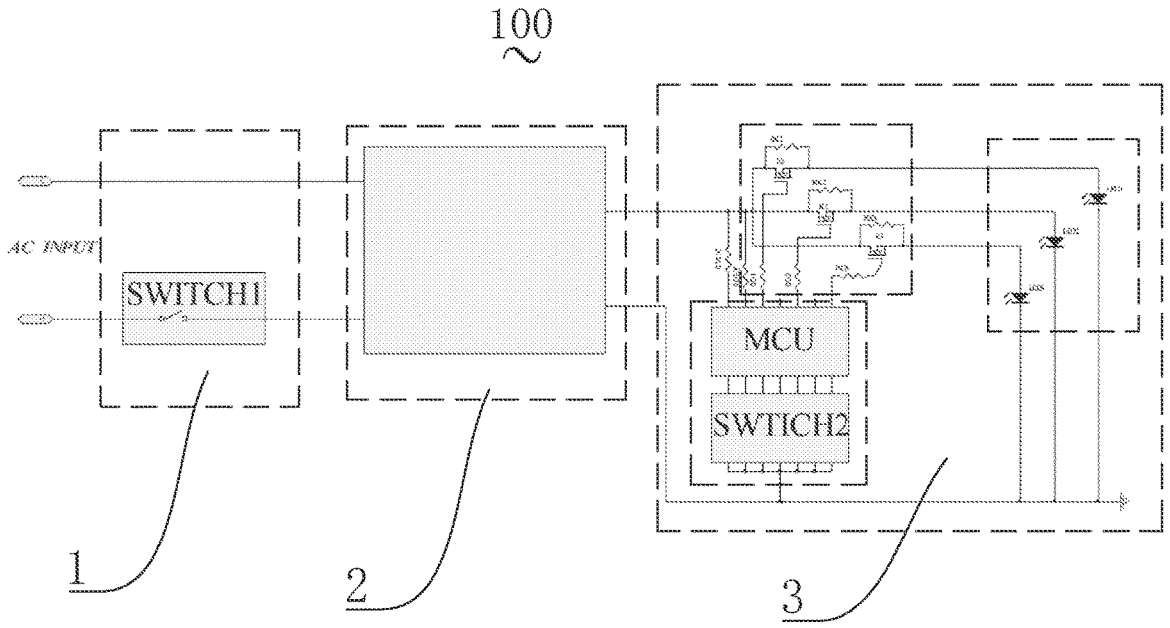
FIG. 3 is a circuit schematic diagram of the lamp-apparatus circuit according to the first embodiment of the present disclosure.
Figure 4:
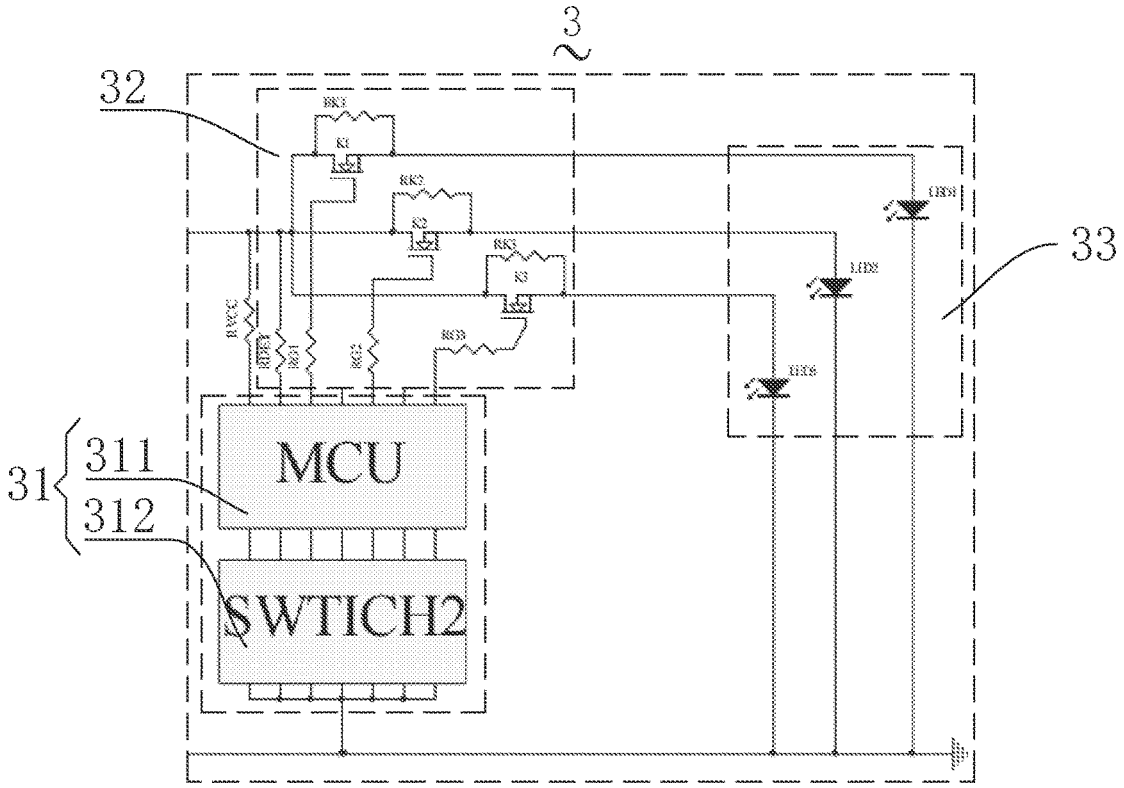
FIG. 4 is a circuit schematic diagram of the dimming module of the lamp-apparatus circuit according to the first embodiment of the present disclosure.

Referring to FIG. 3 and FIG. 4, the light-emitting circuit 33 includes a plurality of light-emitting branch circuits in parallel, and the dimming circuit 32 is correspondingly provided with a plurality of dimming branch circuits. The input and output terminals of each of the dimming branch circuits are respectively connected to the multi-position control circuit 31 and the corresponding light-emitting branch circuits. The input terminals of the light-emitting branch circuits are connected to the output terminal of the driving module 2, and the output terminals of all light-emitting branch circuits are grounded simultaneously.

It can be understood that the color temperature of the plurality of parallel light-emitting branch circuits is adjusted via the plurality of dimming branch circuits, which makes the light-emitting circuit 33 more diverse in lighting. The overall brightness of the lamp-apparatus circuit 100 can be effectively improved by arranging the plurality of light-emitting branch circuits in parallel, which improves the practicability of the lamp-apparatus circuit 100. The voltage of each of the light-emitting branch circuits is equal by arranging the plurality of light-emitting branch circuits in parallel, which is more conducive to controlling the close and open circuits of the light-emitting branch circuits, and further improves the practicability and controllability of the lamp-apparatus circuit 100.

Referring to FIG. 3 to FIG. 6, the light-emitting branch circuit includes a cold-light branch circuit and a warm-light branch circuit.

Figure 5:
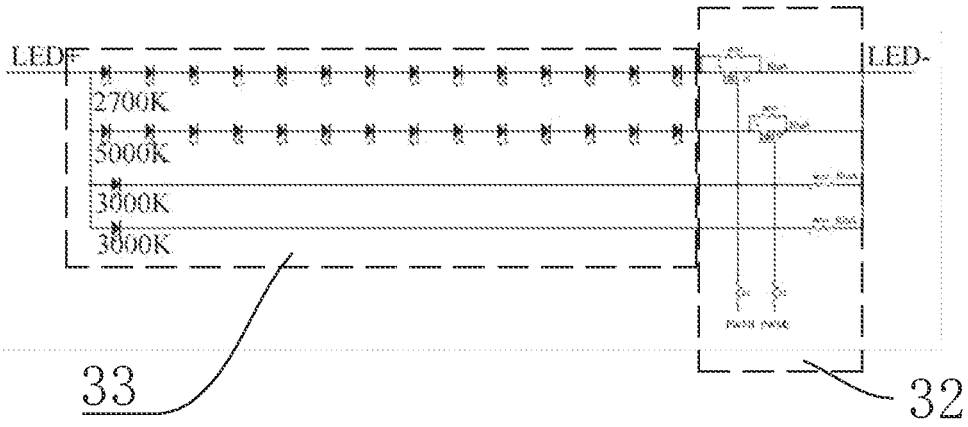
FIG. 5 is a circuit schematic diagram of a light-emitting circuit and the dimming circuit of the lamp-apparatus circuit according to the first embodiment of the present disclosure.

Referring to FIG. 5, specifically, in this embodiment, the light-emitting branch circuit includes a 2700K, a 5000K and two 3000K color temperature light-emitting branch circuits.

Figure 6:
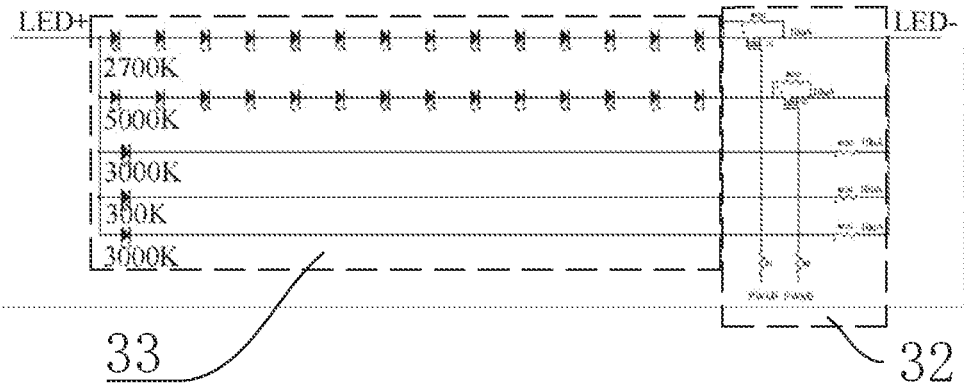
FIG. 6 is another circuit schematic diagram of the light-emitting circuit and the dimming circuit of the lamp-apparatus circuit according to the first embodiment of the present disclosure.

Referring to FIG. 6, in another embodiment, the light-emitting branch circuit includes a 2700K, a 5000K, two 3000K and a 300K color temperature light-emitting branch circuits.

Referring to FIG. 3 to FIG. 6 again, each of the light-emitting branch circuits includes at least one light-emitting diode.

It can be understood that the number of light-emitting diodes can be set according to actual requirements. By arranging a plurality of light-emitting diodes, the brightness of the lamp-apparatus circuit 100 can be effectively improved, and the practicability thereof can be accordingly improved.

Specifically, in this embodiment, each of the light-emitting branch circuits includes one light-emitting diode.

Optionally, when the light-emitting branch circuits include a plurality of light-emitting diodes, the light-emitting diodes on the same light-emitting branch circuit can be connected in series or in parallel.

Specifically, in this embodiment, both the 2700K and the 5000K color temperature light-emitting branch circuits are connected with a plurality of light-emitting diodes in series, and the 3000K color temperature light-emitting branch circuit is provided with one light-emitting diode. It can be understood that the number of light-emitting diodes on each of the color temperature light-emitting branch circuits can be set according to actual requirements.

Further, the multi-position control circuit 31 includes an MCU 311 and a multi-position switch 312 that are electrically connected. The first terminals of each position of the multi-position switch 312 are connected to the corresponding function pin of the MCU 311, and the second terminals thereof are grounded simultaneously. The MCU 311 is provided with a plurality of signal terminals, and the MCU 311 is connected to the corresponding input terminals of the dimming branch circuits via the signal terminals. The signal terminal of the MCU 311 includes seven pins, and the third pin, the fifth pin and the seventh pin thereof are respectively connected with the corresponding input terminals of the dimming branch circuits.

Further, the multi-position switch 312 includes a plurality of first-type-position switches, and the MCU 311 can output different PWM signals by toggling different position switches, thereby adjusting the light-emitting circuit 33 to work at different color temperatures.

It can be understood that by toggling the first-type-position switches, the MCU 311 can be controlled to output different PWM signals to adjust the color temperature of the light-emitting circuit 33, which is convenient for the user to operate. The number of the first-type positions is more than one, which enhances the color temperature adjustment function of the lamp-apparatus circuit 100 and makes the color temperature of the lamp apparatus more diverse.

Specifically, in this embodiment, the multi-position switch 312 includes five first-type-position switches.

Referring to FIG. 3 and FIG. 4 again, the multi-position switch 312 includes a second-type-position switch. By toggling the second-type-position switch, the MCU 311 will cyclically output PWM signals corresponding to each of the first-type-position switches based on the switching times of the switch module 1, so as to automatically switch the color temperature of the light-emitting circuit 33. The MCU 311 will cyclically output PWM signals corresponding to each of the first-type-position switches based on the switching times of the switch module 1 in a forward sequence, a reverse sequence or an out-of-order sequence, so as to automatically switch the color temperature of the light-emitting circuit.

It can be understood that in addition to manually switching the color temperature, the lamp-apparatus circuit 100 can also enter the automatic color temperature switching mode by toggling the second-type-position switch, which improves the intelligence of the lamp-apparatus circuit 100 and further enhances the practicality thereof.

It should be noted that, in practical applications, the switch module 1 of the lamp-apparatus circuit 100 is usually disposed on the wall, and the multi-position control circuit 31 is disposed inside the lamp apparatus. The color temperature adjustment function is more for the staff to adjust the color temperature at the factory.

In addition, the color temperature of the lamp apparatus can also be adjusted to a color temperature that is more popular with consumers according to product sales.

Further, the dimming circuit 32 includes a MOS transistor, two conducting terminals of the MOS transistor is connected in series between the light-emitting diode of the light-emitting branch circuit and the driving module 2, and the control terminal of the MOS transistor is connected to the signal terminal of the MCU 311. The MCU 311 controls the current of the MOS transistor via the signal terminal to realize the color temperature adjustment of the light-emitting circuit 33.

Further, a resistor, for current limiting, is connected in series between the signal terminal of the MCU 311 and the control terminal of the MOS transistor.

Further, the two conducting terminals of each MOS transistor are both connected with protection resistors in parallel to prevent the MOS transistor from being damaged.

It should be noted that the unique feature of this circuit is that a current-limiting resistor is connected between the D pin and the S pin of the MOS transistor. When the MOS transistor is turned off, a small current flows through the resistor, so that the LED maintains the working state continuously, which realizes the control of color temperature accurately.

It can be understood that the lamp-apparatus circuit 100 realizes the adjustment of the color temperature of the light-emitting circuit 33 by adjusting the current of the MOS transistor, which is simple in structure and high in accuracy.

Further, referring to FIG. 3 and FIG. 4 again, the switch module 1 includes a TRIAC dimming switch. as a silicon-controlled rectifier, It can be understood that the TRIAC, as a silicon-controlled rectifier, can realize a non-contact control of alternating current in the circuit, which has high reliability.

The TRAIC, meanwhile, enables the user to steplessly control the brightness of the light-emitting circuit 33.

Further, the drive module 2 includes a PWM constant-current chip.

It can be understood that a stable current can be provided for the dimming module 3 via the PWM constant-current chip, thereby ensuring the stable operation of the dimming module 3.

Figure 7:
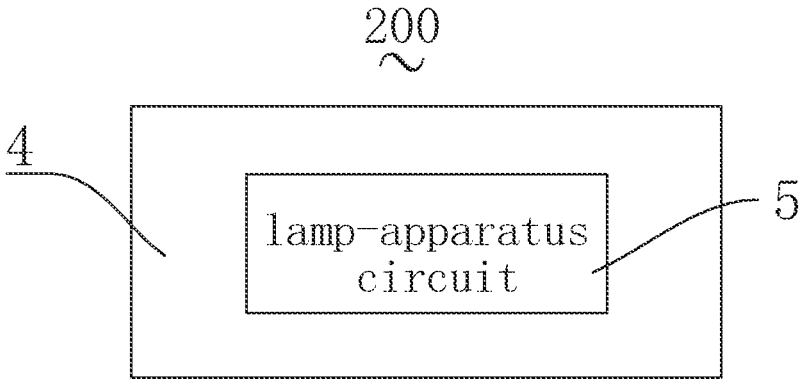
FIG. 7 is a block diagram of a lamp apparatus according to a second embodiment of the present disclosure.

Referring to FIG. 7, a second embodiment of the present disclosure further provides a lamp apparatus 200, which includes a main body 4 and a circuit component 5 disposed inside the main body 4, and the circuit component 5 is the lamp-apparatus circuit 100 of the first embodiment.

It can be understood that since the circuit of the lamp apparatus 200 is the lamp-apparatus circuit 100 of the first embodiment, the lamp apparatus 200 also has the same beneficial effects as the lamp-apparatus circuit 100.

Compared with the prior art, the lamp apparatus and the lamp-apparatus circuit of the present disclosure have the following beneficial effects.

A lamp-apparatus circuit includes a switch module, a drive module and a dimming module that are electrically connected. The input and output terminals of the switch module are respectively connected to the power supply and the input terminal of the drive module, and the switch module is used to adjust the current of the output terminal of the drive module. The output terminal of the drive module is connected to the dimming module to drive the dimming module. The dimming module includes a multi-position control circuit, a dimming circuit and a light-emitting circuit that are electrically connected. The dimming circuit is connected in series with the light-emitting circuit, and the multi-position control circuit adjusts the color temperature of the light-emitting circuit by controlling the dimming circuit. It can be understood that, in the lamp-apparatus circuit of this embodiment, the dimming module can be adjusted as a whole by adjusting the current via the switch module, and the color temperature of the light-emitting circuit can be adjusted via the control circuit and the dimming circuit in the dimming module. Thus, the color temperature adjustment means of the lamp apparatus are more diverse and more convenient; moreover, the control circuit is a multi-position control circuit, which improves the flexibility of the color temperature adjustment of the lamp apparatus.

The light-emitting circuit of the present disclosure includes a plurality of light-emitting branch circuits in parallel, and the dimming circuit is correspondingly provided with a plurality of dimming branch circuits. The input and output terminals of each of the dimming branch circuits are respectively connected to the multi-position control circuit and the corresponding light-emitting branch circuits. The input terminals of the light-emitting branch circuits are connected to the output terminal of the driving module, and the output terminals of all light-emitting branch circuits are grounded simultaneously. The overall brightness of the lamp-apparatus circuit can be effectively improved via the plurality of light-emitting branch circuits in parallel, which improves the practicability of the lamp-apparatus circuit. The voltage of each of the light-emitting branch circuits is equal by arranging the plurality of light-emitting branch circuits in parallel, which is more conducive to controlling the close and open circuit of the light-emitting branch, and further improves the practicability and controllability of the lamp-apparatus circuit.

Each of the light-emitting branch circuits of the present disclosure includes at least one light-emitting diode. It can be understood that the number of light-emitting diodes can be set according to actual requirements. By arranging a plurality of light-emitting diodes, the brightness of the lamp-apparatus circuit 100 can be effectively improved, and the practicability thereof can be accordingly improved.

The multi-position control circuit includes an MCU and a multi-position switch that are electrically connected. The first terminals of each position of the multi-position switch are connected to the corresponding function pin of the MCU, and the second terminals thereof are grounded simultaneously. The MCU is provided with a plurality of signal terminals, and the MCU is connected to the corresponding input terminals of the dimming branch circuits via the signal terminals. The signal terminal of the MCU includes seven pins, and the third pin, the fifth pin and the seventh pin thereof are respectively connected with the corresponding input terminals of the dimming branch circuits. The multi-position switch includes a plurality of first-type-position switches, and the MCU can output different PWM signals by toggling different position switches, thereby adjusting the light-emitting circuit to work at different color temperatures. It can be understood that by toggling the first-type-position switch, the MCU can be controlled to output different PWM signals to adjust the color temperature of the light-emitting circuit, which is convenient for the user to operate. The number of the first-type positions is more than one, which enhances the color temperature adjustment function of the lamp-apparatus circuit and makes the color temperature of the lamp apparatus more diverse.

The multi-position switch includes a second-type-position switch. By toggling the second-type-position switch, the MCU will cyclically output PWM signals corresponding to each of the first-type-position switches based on the switching times of the switch module, so as to automatically switch the color temperature of the light-emitting circuit. It can be understood that in addition to manually switching the color temperature, the lamp-apparatus circuit can also enter the automatic color temperature switching mode by toggling the second-type-position switch, which improves the intelligence of the lamp-apparatus circuit and further enhances the practicality thereof.

The dimming circuit includes a MOS transistor, two conducting terminals of the MOS transistor is connected in series between the light-emitting diode of the light-emitting branch circuit and the driving module, and the control terminal of the MOS transistor is connected to the signal terminal of the MCU. The MCU controls the current of the MOS transistor via the signal terminal to realize the color temperature adjustment of the light-emitting circuit. It can be understood that the lamp-apparatus circuit realizes the adjustment of the color temperature of the light-emitting circuit by adjusting the current of the MOS transistor, and is simple in structure and high in accuracy.

The switch module includes a TRIAC dimming switch. It can be understood that the TRIAC, as a silicon-controlled rectifier, can realize a non-contact control of alternating current in the circuit, which has high reliability.

The drive module includes a PWM constant-current chip. It can be understood that a stable current can be provided for the dimming module via the PWM constant-current chip, thereby ensuring the stable operation of the dimming module.

To solve the above problem, the present disclosure further provides a lamp apparatus, the circuit of the lamp apparatus is the above-mentioned lamp-apparatus circuit, so the lamp apparatus also has the same beneficial effect as the above-mentioned lamp-apparatus circuit.

The foregoing descriptions are only preferred embodiments of the present disclosure, and should not be construed as limiting the scope of the disclosure. Any modifications, equivalent replacements and improvements made within the principles of the present disclosure should be included within the protection scope of the present disclosure.

The invention claimed is:

1. A lamp-apparatus circuit, comprising a switch module, a drive module and a dimming module that are electrically connected; wherein;

input and output terminals of the switch module being respectively connected to a power supply and an input terminal of the drive module, and the switch module being used to adjust a current of an output terminal of the drive module; the output terminal of the drive module being connected to the dimming module to drive the dimming module and;

the dimming module comprising a multi-position control circuit, a dimming circuit and a light-emitting circuit that are electrically connected, the dimming circuit being connected in series with the light-emitting circuit, and the multi-position control circuit adjusting the color temperature of the light-emitting circuit by controlling the dimming circuit;

and the dimming circuit being correspondingly provided with a plurality of dimming branch circuits; wherein the multi-position control circuit comprises a micro controller unit (MCU) and a multi-position switch that are electrically connected; the first terminals of each position of the multi-position switch being connected to the corresponding function pin of the micro controller unit (MCU), and the second terminals thereof being grounded simultaneously; the micro controller unit (MCU) being provided with a plurality of signal terminals, and the micro controller unit (MCU) being connected to the corresponding input terminals of the dimming branch circuits via the signal terminals.

2. The lamp-apparatus circuit according to claim 1, wherein the dimming module comprises a correlated color temperature (CCT) control circuit.

3. The lamp-apparatus circuit according to claim 1, wherein the light-emitting circuit comprises a plurality of light-emitting branch circuits in parallel, input and output terminals of each of the dimming branch circuits being respectively connected to the multi-position control circuit and the corresponding light-emitting branch circuits; input terminals of the light-emitting branch circuits being connected to the output terminal of the driving module, and the output terminals of all the light-emitting branch circuits being grounded simultaneously.

4. The lamp-apparatus circuit according to claim 3, wherein each of the light-emitting branch circuits comprises at least one light-emitting diode.

5. The lamp-apparatus circuit according to claim 3, wherein the color temperature of each of the light-emitting branch circuits being the same or different.

6. The lamp-apparatus circuit according to claim 3, wherein the number of light-emitting diodes in each of the light-emitting branches being equal or unequal.

7. The lamp-apparatus circuit according to claim 1, wherein the signal terminal of the MCU comprises seven pins, and the third pin, the fifth pin and the seventh pin thereof being respectively connected with the corresponding input terminals of the dimming branch circuits.

8. The lamp-apparatus circuit according to claim 1, wherein the multi-position switch comprises a plurality of first-type-position switches, and the MCU can output different PWM signals by toggling different position switches, thereby adjusting the light-emitting circuit to work at different color temperatures.

9. The lamp-apparatus circuit according to claim 8, wherein the multi-position switch comprises a second-type-position switch; by toggling the second-type-position switch, the MCU will cyclically output PWM signals corresponding to each of the first-type-position switches based on the switching times of the switch module, so as to automatically switch the color temperature of the light-emitting circuit.

10. The lamp-apparatus circuit according to claim 8, wherein the MCU will cyclically output PWM signals corresponding to each of the first-type-position switches based on the switching times of the switch module in a forward sequence, a reverse sequence or an out-of-order sequence, so as to automatically switch the color temperature of the light-emitting circuit.

11. The lamp-apparatus circuit according to claim 1, wherein the dimming circuit comprises a MOS transistor, two conducting terminals of the MOS transistor being connected in series between the light-emitting diode of the light-emitting branch circuit and the driving module, and the control terminal of the MOS transistor being connected to the signal terminal of the MCU; the MCU controlling the current of the MOS transistor via the signal terminal to realize the color temperature adjustment of the light-emitting circuit.

12. The lamp-apparatus circuit according to claim 1, wherein the switch module comprises a TRIAC dimming switch.

13. The lamp-apparatus circuit according to claim 1, wherein the drive module comprises a PWM constant-current chip.

14. A lamp apparatus, wherein the circuit of the lamp apparatus is the lamp-apparatus circuit according to claim 1.

15. The lamp apparatus according to claim 14, wherein the dimming module comprises a correlated color temperature (CCT) circuit.

16. The lamp apparatus according to claim 14, wherein light-emitting circuit comprises a plurality of light-emitting branch circuits in parallel, and the dimming circuit being correspondingly provided with a plurality of dimming branch circuits; input and output terminals of each of the dimming branch circuits being respectively connected to the multi-position control circuit and the corresponding light-emitting branch circuits; input terminals of the light-emitting branch circuits being connected to the output terminal of the driving module, and the output terminals of all the light-emitting branch circuits being grounded simultaneously.

* * * * *